US010119716B2

(12) United States Patent
Maeda et al.

(10) Patent No.: US 10,119,716 B2
(45) Date of Patent: Nov. 6, 2018

(54) AIR-CONDITIONING APPARATUS CONTROLLER AND AIR-CONDITIONING SYSTEM

(71) Applicants: Kazuo Maeda, Tokyo (JP); Hirotaka Masui, Cypress, CA (US); Masato Tanigawa, Tokyo (JP)

(72) Inventors: Kazuo Maeda, Tokyo (JP); Hirotaka Masui, Cypress, CA (US); Masato Tanigawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 296 days.

(21) Appl. No.: 13/852,240

(22) Filed: Mar. 28, 2013

(65) Prior Publication Data

US 2014/0184418 A1 Jul. 3, 2014

(30) Foreign Application Priority Data

Dec. 27, 2012 (JP) ..... 2012-284821

(51) Int. Cl.
*F24F 11/52* (2018.01)
*F24F 11/00* (2018.01)
(Continued)

(52) U.S. Cl.
CPC ..... *F24F 11/0086* (2013.01); *F24F 11/30* (2018.01); *F24F 11/52* (2018.01); *G08B 5/36* (2013.01)

(58) Field of Classification Search
CPC . F24F 11/0086; F24F 2011/0091; G08B 5/36; G06F 3/0416; H05B 33/0857; H05B 33/0863
See application file for complete search history.

(56) References Cited

U.S. PATENT DOCUMENTS 6,133,844 A * 10/2000 Ahne ..... G06K 15/00 340/525
6,255,960 B1 * 7/2001 Ahne ..... G06K 15/00 340/525
(Continued)

FOREIGN PATENT DOCUMENTS

JP 2002-188846 A 7/2002
JP 2008-241089 A 10/2008
(Continued)

OTHER PUBLICATIONS

Daikin (Daikin Engineering Data Navigation Remote Controller (Wired Remote Controller) BRC1E71, Daikin AC (Americas), Inc., EDUS72-975, pp. 1-44, Printed in U.S.A. Oct. 2009).*
(Continued)

*Primary Examiner* — Laura Nguyen
(74) *Attorney, Agent, or Firm* — Posz Law Group, PLC

(57) ABSTRACT

An air-conditioning apparatus controller includes a light-emitting indicator that emits light in a plurality of colors, a main display that displays a setting screen for light-emitting indication by the light-emitting indicator, a touch panel through which an instruction related to settings displayed on the main display is input, a data processing unit of a controller that causes the main display to display the setting screen, and performs setting processing for assigning an indication color to an indication content to be provided by the light-emitting indicator, in accordance with the instruction transmitted from the touch panel, and a data storage unit that stores settings for the processing performed by the data processing unit.

24 Claims, 9 Drawing Sheets

(51) Int. Cl.
*F24F 11/30* (2018.01)
*G08B 5/36* (2006.01)

(56) References Cited

U.S. PATENT DOCUMENTS 7,809,472 B1 * 10/2010 Silva ..... F24F 3/065 165/200
2002/0105409 A1 * 8/2002 Nakamitsu ..... G05B 23/0216 340/3.1
2005/0002198 A1 * 1/2005 Blechschmidt ..... B64D 11/00 362/470
2006/0016898 A1 * 1/2006 Ashworth ..... G05D 23/1902 236/1 C
2006/0038696 A1 * 2/2006 Arcaria ..... G08B 3/10 340/691.3
2009/0303072 A1 * 12/2009 Gilling ..... G08B 5/36 340/815.45
2010/0253531 A1 * 10/2010 Qiu ..... G08B 5/36 340/691.3
2011/0127930 A1 * 6/2011 Bennette ..... H05B 33/0863 315/312
2012/0293444 A1 * 11/2012 Wong ..... G06F 3/05 345/174
2012/0320262 A1 * 12/2012 Chung ..... H05B 33/0863 348/370
2013/0345882 A1 * 12/2013 Dushane ..... G05B 15/02 700/276
2014/0160085 A1 * 6/2014 Rabii ..... G06F 1/3262 345/178
2015/0002468 A1 * 1/2015 Townsley ..... G06F 3/0412 345/174

FOREIGN PATENT DOCUMENTS

JP 2009-144953 A 7/2009
JP 2009-229009 A 10/2009
JP 2009-270779 A 11/2009
JP 2009270779 A * 11/2009

OTHER PUBLICATIONS

Office Action dated May 31, 2016 in the corresponding JP application No. 2012-284821 (with English translation).
Daikin Engineering Data Navigation Remote Controller (Wired Remote Controller) BRC1E71, Daikin AC (Americas), Inc., EDUS72-975, pp. 1-44, Printed in U.S.A. Oct. 2009.

* cited by examiner

FIG. 5A

| 1. OPERATION MODE INDICATION | | |
|---|---|---|
| OPERATION MODE | COLOR | MODE |
| COOL | BLUE | ON |
| DRY | L. BLUE | BLINK |
| FAN | WHITE | ON |
| BACK | ▼ | OK |

FIG. 5B

| No. | ITEM | | COLOR | | | | | | | | | | INDICATION MODE (Formal) | | |
|---|---|---|---|---|---|---|---|---|---|---|---|---|---|---|---|
| | | | BLUE | L BLUE | WHITE | PURPLE | GREEN | ORANGE | RED | PINK | Y GREEN | YELLOW | ON (Lit) | BLINK | OFF (Unlit) |
| 1 | ON | COOL | ● | | | | | | | | | | ● | | |
| 2 | | DRY | | ● | | | SELECTED BY USER | | | | | | ● | SELECTED BY USER | |
| 3 | | FAN | | | ● | | | | | | | | ● | | |
| 4 | | AUTO | | | | ● | | | | | | | ● | | |
| 5 | | SETBACK | | | | | ● | | | | | | ● | | |
| 6 | | HEAT | | | | | | ● | | | | | ● | | |
| 7 | ERROR | | | | | | | | ● | | | | | ● | |
| 8 | OFF | | | | | | | | | | | | | | ● |
| 9 | | | | | | | | | | | | | | | |
| 10 | | | | | | | | | | | | | | | |

FIG. 6A

| 2. ROOM TEMPERATURE INDICATION | | |
|---|---|---|
| ROOM TEMP. RANGE | COLOR | MODE |
| 0-10℃ | BLUE | BLINK |
| 11-15℃ | L. BLUE | ON |
| 16-20℃ | GREEN | ON |
| BACK | ▼ | OK |

FIG. 6B

| No. | ITEM | | COLOR | | | | | | | | | | INDICATION MODE (Formal) | | |
|---|---|---|---|---|---|---|---|---|---|---|---|---|---|---|---|
| | | | BLUE | L. BLUE | WHITE | PURPLE | GREEN | ORANGE | RED | PINK | Y. GREEN | YELLOW | ON (Lit) | BLINK | OFF (Unlit) |
| 1 | ON | 0~10℃ | ● | | | | | | | | | | | ● | |
| 2 | | 11~15℃ | | ● | | | SELECTED BY USER | | | | | | ● | | |
| 3 | | 16~20℃ | | | | | ● | | | | | | ● | SELECTED BY USER | |
| 4 | | 21~25℃ | | | | | | | | | ● | | ● | | |
| 5 | | 26~30℃ | | | | | | | | | | ● | ● | | |
| 6 | | 31~35℃ | | | | | | | | ● | | | ● | | |
| 7 | | 36~ | | | | | | ● | | | | | | ● | |
| 8 | OFF | | | | | | | | | | | | | | ● |
| 9 | ERROR | | | | | | | | ● | | | | | | |
| 10 | | | | | | | | | | | | | | ● | |

FIG. 7A

| 3. OPERATIONAL STATUS INDICATION | | | |
|---|---|---|---|
| OPERATIONAL STATUS | COLOR | | MODE |
| ON | GREEN | | ON |
| OFF | NONE | | OFF |
| ERROR | RED | | BLINK |
| BACK | ▼ | | OK |

FIG. 7B

| | ITEM | COLOR | | | | | | | | | | INDICATION MODE (Formal) | | |
|---|---|---|---|---|---|---|---|---|---|---|---|---|---|---|
| | | BLUE | L.BLUE | WHITE | PURPLE | GREEN | ORANGE | RED | PINK | Y.GREEN | YELLOW | ON (Lit) | BLINK | OFF (Unlit) |
| 1 | ON | | | | | ● | | | | | | ● | | |
| 2 | OFF | | | | SELECTED BY USER | | | | | | | | | ● |
| 3 | ERROR | | | | | | | ● | | | | | ● | |
| 4 | TEST OPERATION | | | | | | | | | | ● | ● | SELECTED BY USER | |
| 5 | ENERGY SAVING | | | | | | | | | ● | | ● | | |
| 6 | | | | | | | | | | | | | | |
| 7 | | | | | | | | | | | | | | |
| 8 | | | | | | | | | | | | | | |
| 9 | | | | | | | | | | | | | | |
| 10 | | | | | | | | | | | | | | |

AIR-CONDITIONING APPARATUS CONTROLLER AND AIR-CONDITIONING SYSTEM

TECHNICAL FIELD

The present invention relates to an air-conditioning apparatus controller and the like, and more specifically, the present invention relates to a controller that provides an indication by emitting light.

BACKGROUND ART

Air-conditioning apparatuses (air conditioners) are usually installed in a high position in the room, such as ceiling, and therefore a controller is often used to operate or indicate the status of such air-conditioning apparatuses, for example.

A related-art air-conditioning apparatus controller has an operational status indication area above an ON/OFF button on the operation surface. In this area, the operational status (ON/OFF/error) is indicated by the state of ON/OFF/blink of an LED, for example, such that the operator can check the operational status (see, for example, Patent Literature 1).

CITATION LIST

Patent Literature

[Patent Literature 1] Japanese Unexamined Patent Application Publication No. 2009-229009 (FIG. 1)

SUMMARY OF INVENTION

Technical Problem

However, in the air-conditioning apparatus controller disclosed in Patent Literature 1, the indication area of the LED in the operational status indication area is small, and the number of indication colors is limited. Therefore, for example, the number of operational states that can be indicated is limited. That is, the amount of information that can be indicated in the operational status indication area is small. Further, since the amount of information that can be indicated is small, it is difficult to configure the settings in accordance with a request from the operator or the like.

The present invention has been made to solve the above problems, and aims to provide an air-conditioning apparatus controller capable of indicating a great amount of information by emitting light in accordance with settings set by the user.

Solution to Problem

An air-conditioning apparatus controller according to the present invention includes a light-emitting indication unit that emits light in a plurality of colors, a setting display unit that displays a setting screen for light-emitting indication by the light-emitting indication unit, setting input means through which an instruction related to settings displayed on the setting display unit is input, a controller that causes the setting display unit to display the setting screen, and performs setting processing for assigning an indication color to an indication content to be provided by the light-emitting indication unit, in accordance with the instruction transmitted from the setting input means, and a storage unit that stores settings for the processing performed by the controller.

Advantageous Effects of Invention

In the air-conditioning apparatus controller according to the present invention, the controller performs setting processing on the light-emitting indication unit that provides light-emitting indication in a plurality of colors, and thus the settings of the indication color of the light-emitting indication by the light-emitting indication unit can be set. This allows the user to arbitrarily set the indication color settings for the content of the light-emitting indication by the light-emitting indication unit, as desired, and thus makes it possible to increase the amount of indication contents.

BRIEF DESCRIPTION OF DRAWINGS

FIG. 5A illustrates an operation mode indication setting screen according to Embodiment 1 of the present invention.

FIG. 5B illustrates an operation mode indication setting screen according to Embodiment 1 of the present invention.

FIG. 6A illustrates a room temperature indication setting screen according to Embodiment 1 of the present invention.

FIG. 6B illustrates a room temperature indication setting screen according to Embodiment 1 of the present invention.

FIG. 7A illustrates an operational status indication setting screen according to Embodiment 1 of the present invention.

FIG. 7B illustrates an operational status indication setting screen according to Embodiment 1 of the present invention.

DESCRIPTION OF EMBODIMENTS

Embodiment 1

Figure 1:
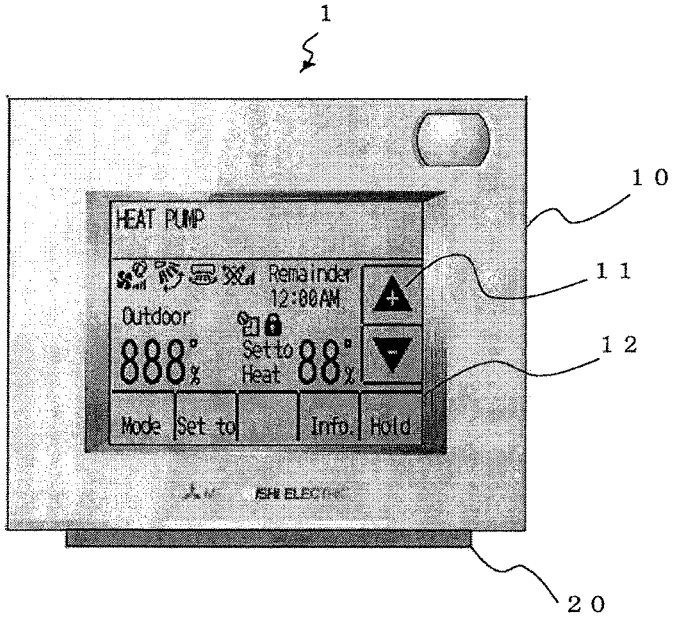
FIG. 1 is an external view of an air-conditioning apparatus controller 1 according to Embodiment 1 of the present invention.

FIG. 1 is an external view illustrating an air-conditioning apparatus controller 1 according to Embodiment 1 of the present invention. The air-conditioning apparatus controller 1 according to Embodiment 1 is a wall-mounted controller.

The air-conditioning apparatus controller 1 according to Embodiment 1 includes a controller main body 10 and a light-emitting indicator 20. The controller main body 10 further includes a main display 11. The main display 11 displays text, numbers, symbols, graphics (icons, pictograms), and the like, so as to indicate functions and operational status of an air-conditioning apparatus or the like, for example. The main display 11 can also display virtual buttons for the user to input an instruction, in cooperation with a touch panel 12. According to Embodiment 1, the main display 11 serves as a setting screen display unit that displays a setting screen for light emission of the light-emitting indicator 20. The touch panel 12 serves as an input unit that transmits to a controller 30 (described below) a signal indicating the instruction which is input by the user or the like, on the basis of the screen displayed on the main display 11. In Embodiment 1, the touch panel 12 serves as a setting instruction input unit that allows the user to select a virtual button or the like on the basis of a setting screen displayed on the main display 11 and thus to input an instruction.

The light-emitting indicator 20 is a light-emitting indication unit that indicates, in specified indication colors, the operation mode (heating, cooling, dry, and so on) of the air-conditioning apparatus, the operational status (ON, error, and OFF), the room temperature detected by a temperature sensor (not shown), for example. The light-emitting indicator 20 not only turns on or off, but also blinks, for example. In the air-conditioning apparatus controller 1 of Embodiment 1, the light-emitting indicator 20 is disposed so as to project from a bottom surface of the controller main body 10, and thus to be located at the lower side of the operation surface. If the light-emitting indicator 20 is disposed on an upper surface or the operation surface of the controller main body 10, it becomes difficult for the user to visually recognize the light-emitting indicator 20 due to the ambient light. In order to prevent the ambient light from becoming incident on the light-emitting indicator 20, the light-emitting indicator 20 is disposed at the lower side of the controller main body 10 so as to be in the shadow of the controller main body 10. In Embodiment 1, the light-emitting indicator 20 is configured to diffuse the light from the light source using a material, such as acrylic, that transmits visible light, and thus emit light so as to provide an indication with an increased indication area. The light-emitting indicator 20 uses a three-color LED as the light source so as to be capable of providing indications in a plurality of colors. In Embodiment 1, the light-emitting indicator 20 is capable of providing indications in ten colors (blue, light blue, white, purple, green, orange, red, pink, yellow green, and yellow), for example.

Figure 2:
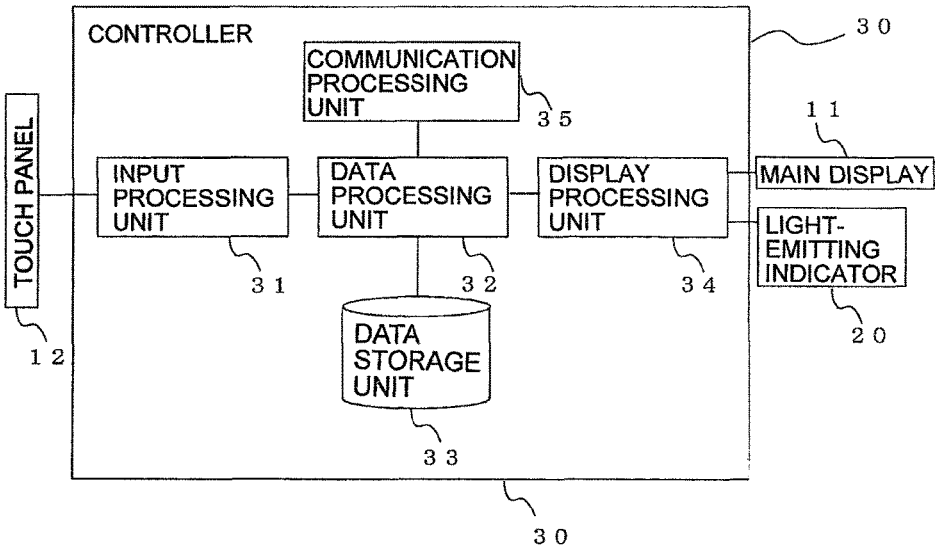
FIG. 2 illustrates the configuration of a controller 30 in the air-conditioning apparatus controller 1 according to Embodiment 1 of the present invention.

FIG. 2 is a diagram illustrating the configuration of the controller 30 in the air-conditioning apparatus controller 1 according to Embodiment 1 of the present invention. The controller 30 is disposed inside the controller main body 10. The controller 30 of Embodiment 1 includes an input processing unit 31, a data processing unit 32, a data storage unit 33, a display processing unit 34, and a communication processing unit 35. In the above description, the controller 30 includes the above-mentioned components. However, these components may be provided as a plurality of independent units and be configured to perform processing by exchanging signals (data) therebetween.

The input processing unit 31 processes a signal transmitted from the touch panel 12 into a format that can be processed by the data processing unit 32. The data processing unit 32 processes data input through the input processing unit 31 or the communication processing unit 35. The data processing unit 32 particularly performs data processing related to settings of the light-emitting indicator 20. In the following, it is assumed that instructions from the user are input through the touch panel 12 and the input processing unit 31 and are processed by the data processing unit 32. The data storage unit 33 includes a storage unit, and stores data necessary for the respective processing units to perform processing. In Embodiment 1, the data storage unit 33 particularly stores data related to the settings for indication by the light-emitting indicator 20.

The display processing unit 34 causes the main display 11 to perform displaying and causes the light-emitting indicator 20 to provide an indication in accordance with an indication signal from the data processing unit 32. In Embodiment 1, the display processing unit 34 causes the main display 11 to display a selection screen or the like for allowing the user to specify the settings for light-emitting indication by the light-emitting indicator 20, for example. The communication processing unit 35 processes signals transmitted from an air-conditioning apparatus (not shown).

As mentioned above, in the air-conditioning apparatus controller 1 of Embodiment 1, since the light-emitting indicator 20 can provide indications in a plurality of colors, it is possible to provide a greater amount of information by light-emitting indication. Accordingly, it is possible to provide indications other than the indication of the operational status by emitting light. In some cases, the meanings of colors differ between countries or between regions, due to their own customs or the like, for example. In view of this, the air-conditioning apparatus controller 1 of Embodiment 1 allows the settings for light emission of the light-emitting indicator 20 to be configured. In the following, the respective settings will be described.

Figure 3:
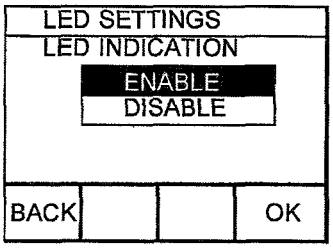
FIG. 3 illustrates a selection screen for setting whether to enable light-emitting indication by a light-emitting indicator 20 of the present invention.

FIG. 3 illustrates a selection screen for setting whether to enable light-emitting indication by the light-emitting indicator 20 according to Embodiment 1 of the present invention. The user can input an instruction as to whether to enable light-emitting indication (LED indication) by the light-emitting indicator 20 through the touch panel 12, on the basis of the selection screen of FIG. 3 that is displayed on the main display 11. If the user selects to disable light-emitting indication, the light-emitting indicator 20 is turned off. Since it is possible to select whether to enable light-emitting indication by the light-emitting indicator 20, it is possible to prevent unnecessary indications from being provided, and to save electricity.

Figure 4:
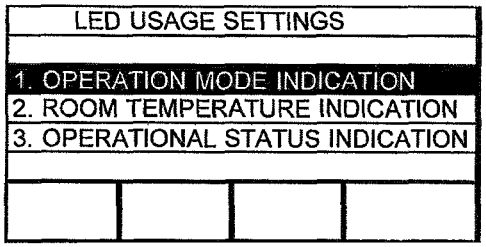
FIG. 4 illustrates a usage setting screen according to Embodiment 1 of the present invention.

FIG. 4 illustrates a usage setting screen according to Embodiment 1 of the present invention. In the case where light-emitting indication by the light-emitting indicator 20 is set to be enabled, the user can specify the type of usage through the touch panel 12, on the basis of the selection screen of FIG. 4 that is displayed on the main display 11. In Embodiment 1, as illustrated in FIG. 4, the user can select one of three types of usage, namely, operation mode, room temperature, and operational status. Note that the type of usages is not limited to these types, and the number of types is not limited to three.

FIG. 5 illustrates an operation mode indication setting screen according to Embodiment 1 of the present invention. In the case where operation mode indication is selected in the usage setting, the user can specify the type of usage through the touch panel 12, on the basis of the selection screen of FIG. 5A that is displayed on the main display 11. In Embodiment 1, as illustrated in FIG. 5B, the user can select an indication color and an indication mode (ON, blink, or OFF) for each of the operation modes, namely, cooling, dry, fan, auto, setback (operation within a set temperature range between a specified lowest temperature and a specified highest temperature), and heating. Further, although these modes are of the ON state, the user can also specify settings for the error state and the OFF state.

FIG. 6 illustrates a room temperature indication setting screen according to Embodiment 1 of the present invention. In the case where room temperature indication is selected in the usage setting, the user can input an instruction related to indication of the room temperature through the touch panel 12, on the basis of the selection screen of FIG. 6A that is displayed on the main display 11. In Embodiment 1, as illustrated in FIG. 6B, the room temperature is divided into seven intervals of 0° C. through 10° C., 11° C. through 15° C., 16° C. through 20° C., 21° C. through 25° C., 26° C. through 30° C., 31° C. through 35° C., and 36° C. or higher, and it is possible to specify an indication color and an indication mode for each interval. It is also possible to specify settings for the error state and the OFF state. Although the temperature is divided into seven intervals in Embodiment 1, the number of intervals is not limited thereto. Further, it is also possible to specify the value of the temperature in each interval. In the above description, settings are made for the room temperature. However, settings may be made for the indoor humidity.

FIG. 7 illustrates an operational status indication setting screen according to Embodiment 1 of the present invention. In the case where operational status indication is selected in the usage setting, the user can input an instruction related to indication of the operational status through the touch panel 12, on the basis of the selection screen of FIG. 7A that is displayed on the main display 11. In Embodiment 1, as illustrated in FIG. 7B, it is possible to specify an indication color and an indication mode for each of ON, OFF, error, test operation, and energy-saving operation.

As described above, the air-conditioning apparatus controller 1 of Embodiment 1 includes the light-emitting indicator 20 that is capable of providing indications in a plurality of colors by emitting light. Further, the data processing unit 32 of the controller 30 performs setting processing, and thus the settings for specifying whether to enable light-emitting indication by the light-emitting indicator 20, the usage, and the indication color of each usage can be set. This allows the user to arbitrarily set the settings for light-emitting indication by the light-emitting indicator 20 as desired. Accordingly, even in the case where the meanings of colors differ between countries or between regions, for example, it is possible to prevent the user from misunderstanding the meaning of the indication color of the light-emitting indication, and thus to allow the user to correctly understand the content of the indication.

Embodiment 2

Figure 8:
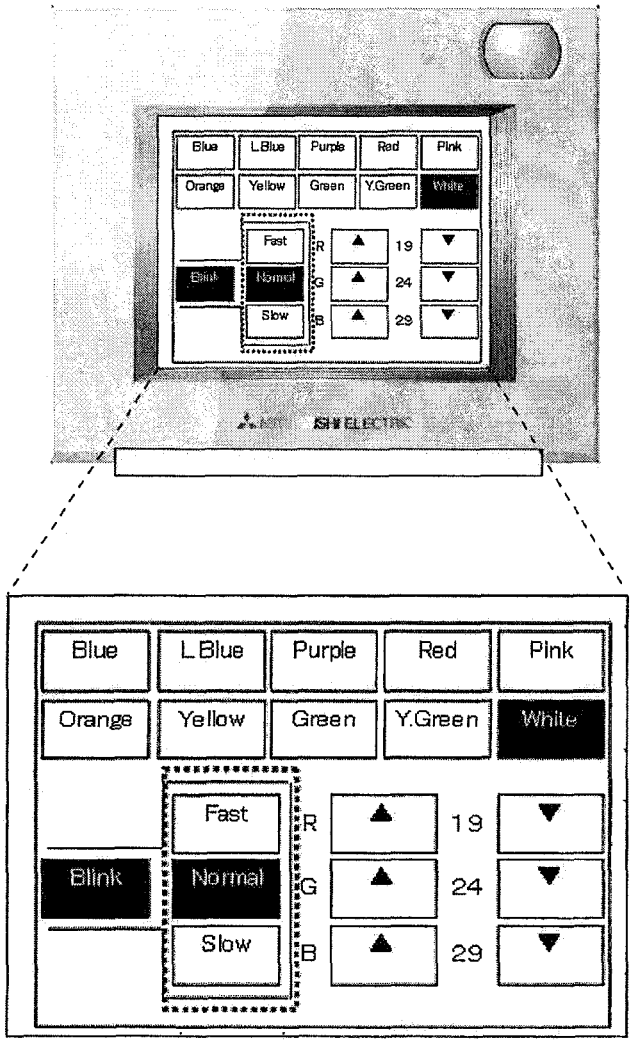
FIG. 8 illustrates a setting screen for light-emitting indication by the light-emitting indicator 20 according to Embodiment 2 of the present invention.

FIG. 8 illustrates a setting screen for light-emitting indication by the light-emitting indicator 20 according to Embodiment 2 of the present invention. As mentioned above, the air-conditioning apparatus controller 1 is capable of providing indications in ten colors. In Embodiment 2, the user can specify the value of R (Red), G (green), and B (blue) in each color so as to perform color adjustment. Further, the user can specify the blink rate (fast, normal, slow) of the light.

As for the RGB settings for each color, buttons corresponding to the respective colors and UP and DOWN buttons for increasing or decreasing the value of each of R, G, and B are displayed on the main display 11 such that the user can specify these settings. When performing setting, the light-emitting indicator 20 may provide an indication by emitting light in the selected color with the selected value such that the user can easily know how the specified color appears. Similarly, the light-emitting indicator 20 may blink at the selected blink rate such that the user can easily know the specified blink rate.

As described above, in the air-conditioning apparatus controller 1 of Embodiment 2, since the settings for adjusting the indication color can be set, it is possible to specify the detailed settings for the indication color. Further, since the blink rate of light-emitting indication can be adjusted, it is possible to allow the blinking to be more easily recognized.

Embodiment 3

Figure 9:
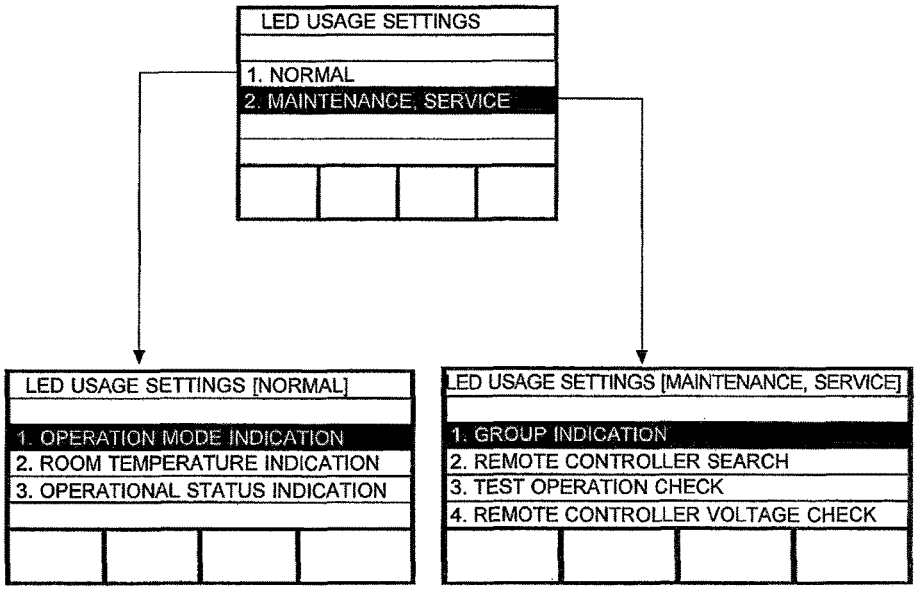
FIG. 9 illustrates a usage setting screen according to Embodiment 3 of the present invention.

FIG. 9 illustrates a usage setting screen according to Embodiment 3 of the present invention. Although not specifically illustrated in the above-described Embodiment 1, the usage may include the usage during normal use (normal usage) and usage during maintenance service (maintenance usage), and the settings for the usage of light-emitting indication by the light-emitting indicator 20 may be set for each of these usages in Embodiment 3. Instructions for specifying the settings may be input through the touch panel 12.

In Embodiment 3, color indication settings for the normal usage will be described. Among the settings for the normal usage, some of the settings are already described in Embodiment 1. The following describes the other settings. In Embodiment 1, the color indication settings for room temperature indication can be set, for example. Other than this, color indication settings for preset temperature, fan speed, and airflow direction can be set, for instance.

For example, the settings can be set such that the indication is blue when the preset temperature is low, and the indication is red when the preset temperature is high. Similarly, in the case of preset humidity, the settings can be set such that the indication is blue when the preset value is low, and the indication is red when the preset value is high. Further, for example, in the case of cooling operation, the settings can be set such that the indication is dark blue when the preset temperature is low, and the indication is light blue when the preset temperature is high so as to represent gradation. In the case of heating operation, the settings can be set such that the indication is light red when the preset temperature is low, and the indication is dark red when the preset temperature is high so as to represent gradation. Further, upon specifying the temperature settings, the color indication settings can be set such that, if the temperature is set to have a predetermined temperature difference, or greater, from the room temperature, an indication in a different color is provided.

Further, the settings can be set such that the indication is yellow when the fan speed is low, and the indication is dark green when the fan speed is high. Further, the settings can be set such that the indication is dark blue when the airflow direction is the downward direction, and the indication is light blue when the airflow direction is the horizontal direction.

Further, in the color indication settings for the normal usage, settings for time passage can be set. According to a related-art technique, as for displaying the passage of time or the like, the current time, the time elapsed from execution of a function, the countdown to execution of a function are displayed on a controller screen. However, it is sometimes difficult to intuitively know how much time has passed by only seeing numbers.

For example, the color indication settings for the time of day can be set. The settings can be set such that the morning hours are indicated by blue; the evening hours are indicated by orange; and the night hours are indicated by purple. Further, for example, the settings can be set such that the color becomes darker as the bed time approaches, and the color becomes lighter as the waking time approaches.

Further, the color indication settings for the time related to execution of a function can beset. For example, the settings can be set such that the light turns on in yellow when it is 30 minutes before execution; the light turns to orange when it is 10 minutes before execution; and the light turns to red when it is one minute before execution. Then, after execution of the function, the elapsed time may be displayed so as to indicate that the function has been executed.

Further, the settings can be set such that the color of the indication becomes darker in accordance with the passage of time from when the filter is cleaned. Further, the settings can be set such that the elapsed time from the occurrence of an error is indicated by color. Further, the settings can be set such that the amount of time during which the user is in the room and the amount of time during which the user is not in the room are represented by gradually changing the color.

Further, the settings can be set such that different colors are used monthly or seasonally, or such that the color is changed in units of one seconds or in units of 10 seconds, in addition to displaying time by hour and minute. For example, if the light-emitting indicator 20 can represent 60 colors or more, 60 seconds can be represented by different colors.

Further, in the color indication settings for the normal usage, settings for the operational status can be set. According to a related-art technique, the operational status and the like are displayed on a controller screen, using numbers, text, and graphics.

For example, the settings can be set such that thermo-ON during the operation is indicated by dark green, and thermo-OFF is indicated by light green. Further, the settings can be set such that a color corresponding to the demand level is displayed. Further, for example, in the case of a multi-air-conditioning apparatus installed in buildings or the like, if there are a plurality of controllers, the indication may be white when the proportion of the controllers performing processing is 0% or greater but less than 50%; the indication may be yellow when the proportion is 50% or greater but less than 90%; and the indication may be green when the proportion is 90% or greater.

Further, for example, the indication may be green when a function for saving energy is being executed, and the indication may be orange when a function for providing comfort is being executed. In this way, a color may be assigned to each of executable functions, and thus the settings may be set such that, when a function is executed, an indication in a color assigned to the function is provided. Further, for example, the settings can be set such that the color of the indication varies depending on whether an ON instruction is issued from the controller or an upper controller.

Further, in the color indication settings for the normal usage, settings for operations of the controller can be set. For example, the settings can be set such that the color (including the brightness) varies in response to a change in the operation sound and screen display. In this case, for example, the settings can be set such that, when an attempt is made to operate a function that is not executable due to restrictions, a color indication indicating that the function cannot be operated is provided. Further, the settings can be set such that, in the case of entering a password or the like, if there is an inputting error, a color indication indicating the inputting error is provided.

Embodiment 4

In the above-described Embodiment 3, color indication settings for the normal usage have been described. In Embodiment 4, color indication settings for the maintenance usage will be described.

In the color indication settings for the maintenance usage, settings for the sensor detection results can be set. For example, the settings can be set such that the indication is blue when the detection value is small (low), and such that the color of the indication becomes darker as the value becomes greater (higher). Further, the settings can be set such that the color of the indication varies in accordance with the difference between the outdoor temperature detected by an outdoor temperature sensor and the room temperature detected by a room temperature sensor.

Further, in the case where the indoor unit or the air-conditioning apparatus controller 1 includes a motion sensor, the settings can be set such that the indication color is changed in response to detection by the motion sensor. Further, the settings can be set such that the color of the indication varies in accordance with the number of detections by the motion sensor. Accordingly, for example, the user or the like can know the frequency of people going out of or coming into the room. Further, in the case where the indoor unit or the air-conditioning apparatus controller 1 includes an illuminance sensor, the settings can be set such that the indication color varies in accordance with the illuminance detected by the illuminance sensor.

Further, in the color indication settings for the maintenance usage, settings for error detection can be set. For example, the settings can be set such that the seriousness of the error is represented by gradation of a warm color or the like. For instance, the indication is yellow when the error is minor, and the indication is red if the error is serious. Accordingly, even if errors occur frequently, it is possible to prevent serious errors from being overlooked.

Further, the settings can be set such that the color of the indication varies in accordance with the type of error. For example, the indication is yellow when the error is a communication error; the indication is red when the error is a refrigerant system error; and the indication is orange when the error is an electric system error. Further, the settings can be set such that the color of the indication varies in accordance with the number of errors.

Figure 10:
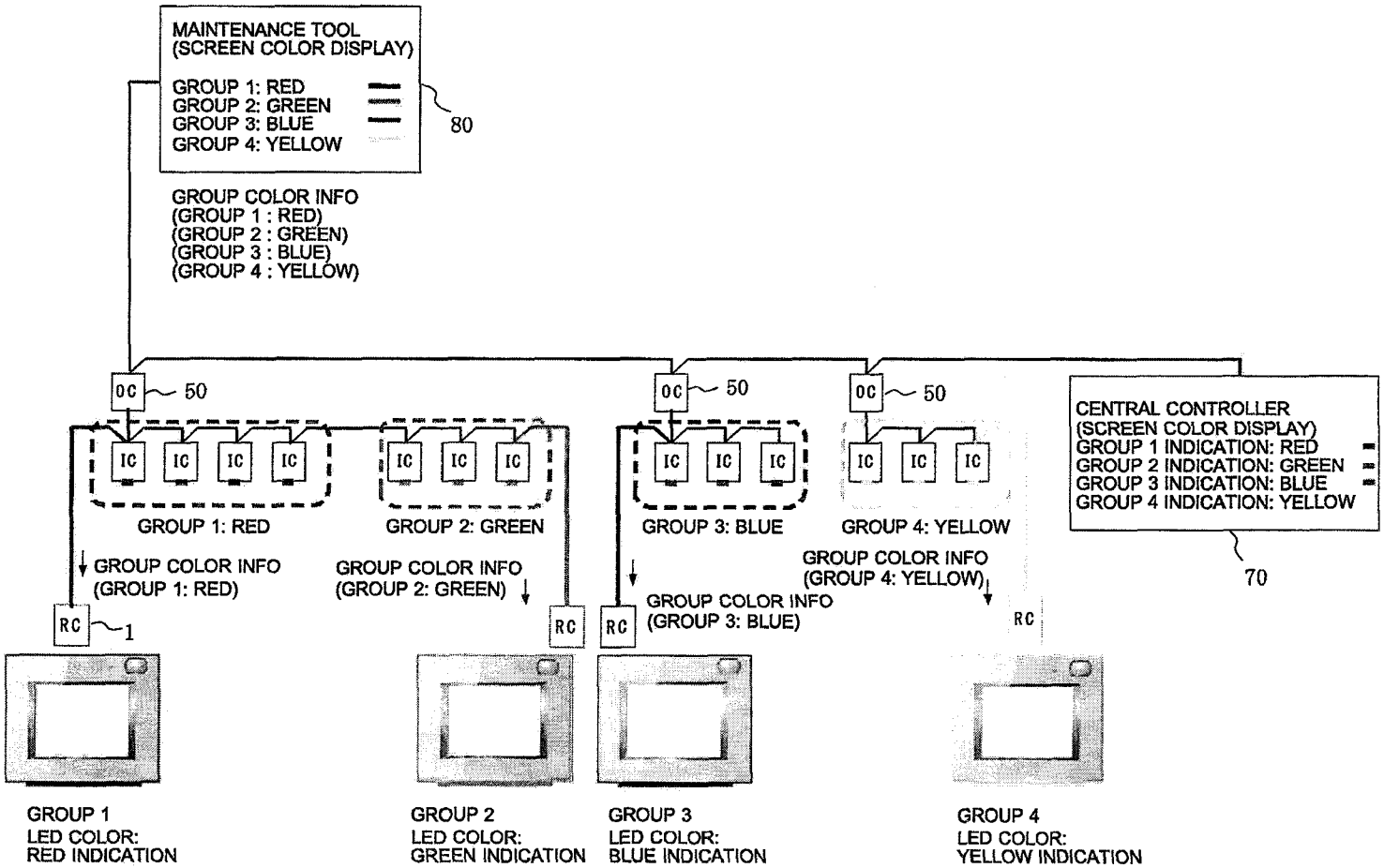
FIG. 10 illustrates indication by groups by an air-conditioning apparatus controller according to Embodiment 4 of the present invention.

FIG. 10 illustrates group indication by an air-conditioning apparatus controller according to Embodiment 4 of the present invention. The air-conditioning apparatus controller according to Embodiment 4 has the same configuration as that of the air-conditioning apparatus controller 1 described in Embodiment 1.

For example, as illustrated in FIG. 10, a multi-air-conditioning apparatus (an air-conditioning system), which may be installed in a building or the like, includes one or more outdoor units (OCs) 50 and one or more indoor units (ICs) 60. It is often the case that outdoor units 50 and the indoor units 60 are connected to each other via communication lines or the like, and that the multi-air-conditioning apparatus includes a central controller 70 and a maintenance tool 80 for controlling the entire system. In such an air-conditioning system, the plural indoor units 60 are divided into groups so as to be managed and controlled. Further, in order to issue instructions to the indoor units of each group, an air-conditioning apparatus controller 1 is provided for each group.

For example, if the user or the like attempts to operate an indoor unit, the user may not know which of the air-conditioning apparatus controllers should be operated. That is, the user may not know the corresponding relationships between the indoor units and the air-conditioning apparatus controllers. Particularly, in the case where a plurality of air-conditioning apparatus controllers are arranged side by side, it is difficult to know the corresponding relationships.

In view of this, in Embodiment 4, an indication color is assigned to each group including an indoor unit IC and an air-conditioning apparatus controller 1, and the light-emitting indicator 20 can provide an indication in a color assigned to the group.

In the system illustrated in FIG. 10, there are four groups. Red is assigned to Group 1; green is assigned to Group 2; blue is assigned to Group 3; and yellow is assigned to Group 4. Further, each indoor unit 60 includes a light-emitting indicator 61 having the same configuration as that of the air-conditioning apparatus controller 1, and is capable of providing an indication in the same color as the air-conditioning apparatus controller 1.

The central controller 70 has a function for specifying a color to be assigned to each group. Further, for example, when a color is assigned to each group, the central controller 70 transmits a signal indicating color information of each group, to the indoor unit 60 and the air-conditioning apparatus controller 1 via the communication lines or the like. Upon receiving the signal, the indoor unit 60 and the air-conditioning apparatus controller 1 set the color indication settings on the basis of the assignment indicated by the signal. In the above description, the settings are set in the central controller 70. However, the invention is not limited thereto. For example, the settings can be set in the air-conditioning apparatus controller 1.

Figure 11A:
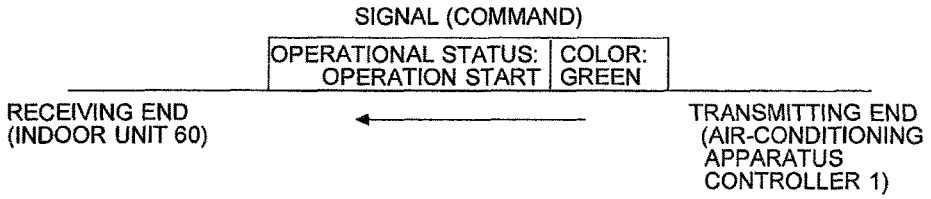
FIG. 11A illustrates an example of a signal transmitted from the air-conditioning apparatus controller 1 to an indoor unit 60.
Figure 11B:
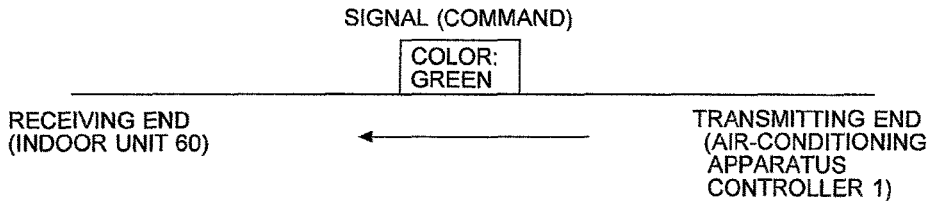
FIG. 11B illustrates an example of a signal transmitted from the air-conditioning apparatus controller 1 to an indoor unit 60.

FIG. 11 illustrates an example of a signal transmitted from the air-conditioning apparatus controller 1 to the indoor unit 60. For example, if an operation instruction is input through the touch panel 12, the controller 30 transmits a signal indicating the instruction to the indoor unit 60 via the communication processing unit 35. At this point, as illustrated in FIG. 11A, for example, a command for instructing provision of an indication in an arbitrarily specified color is contained in the signal indicating an operation (for example, operation start), and thus is transmitted. A signal for instructing provision of an indication in the color assigned to the group may be transmitted. Upon receiving the signal, the indoor unit 60 performs an action corresponding to the operation, and causes the light-emitting indicator 61 to provide a color indication in accordance with the transmitted command. Since the indoor unit 60 provides a color indication in accordance with the operation of the air-conditioning apparatus controller 1, it is possible to identify the corresponding relationships between the air-conditioning apparatus controllers 1 and the indoor units 60, such as the group relationship. In the above description, the corresponding relationships are confirmed upon performing an operation. However, the relationships may be confirmed at any time. Further, the command for instructing provision of a color indication is contained in the signal to be transmitted from the air-conditioning apparatus controller 1 to the indoor unit 60. However, the present invention is not limited thereto. For example, a command for instructing provision of a color indication may be contained in a signal to be transmitted from the indoor unit 60 to the air-conditioning apparatus controller 1. Further, a command for instructing provision of a color indication may be contained not only in signals related to air conditioning operations, but also in signals related to other operations. Further, as illustrated in FIG. 11B, a command for instructing provision of an indication in an arbitrarily specified color may be sent alone.

In the case where a plurality of air-conditioning apparatus controllers 1 are provided in the system, a light emission instruction may be issued from one of the air-conditioning apparatus controllers 1 to another one of the air-conditioning apparatus controllers 1. For example, a maintenance service personnel or the like who is not involved in the installation may not know where the air-conditioning apparatus controller 1 is located.

In view of this, the air-conditioning apparatus controller 1 of Embodiment 4 is configured such that an address assigned to an air-conditioning apparatus controller 1 that is being looked for and data of an indication color can be input. If the address and the data of the indication color are input from one air-conditioning apparatus controller 1, a signal is transmitted to the air-conditioning apparatus controller 1 to which the input address is assigned. The air-conditioning apparatus controller 1 having received the signal provides an indication in a color in accordance with the data transmitted to the light-emitting indicator 20.

In the above description, the signal is transmitted from the air-conditioning apparatus controller 1 to the air-conditioning apparatus controller 1 that is being looked for. However, a signal may be transmitted from the central controller 70, the maintenance tool 80, or the like, for example.

Further, for example, if an outdoor unit 50 and data of an indication color are specified, a light-emitting indicator 20 of an air-conditioning apparatus controller 1 that is connected for operating a refrigerant system of the specified outdoor unit 50 provides an indication in the specified color. This makes it easy to find an air-conditioning apparatus controller 1 that is being looked for.

Further, for example, after the system is installed, a test operation or the like is conducted. For instance, in the case of a related-art controller, a check sheet or the like is used to identify on which refrigerant system a test operation has been completed. Further, the related-art controller merely indicates whether the operational state is ON or OFF.

In view of this, the air-conditioning apparatus controller 1 of Embodiment 4 is capable of providing a color indication related to a test operation. For example, in an air-conditioning apparatus controller 1 related to operations of a refrigerant system of which test operation has been completed, a light-emitting indicator 20 thereof provides an indication in green. Further, the light-emitting indicator 20 provides an indication in blue when a test operation is being conducted, and provides an indication in red when a test operation is not conducted.

Further, the status during the test operation may be represented by gradation. For example, the indication may be light blue when a test operation is started, and the indication may be dark blue when the test operation is finished. In the above description, the air-conditioning apparatus controller 1 of which test operation has been completed provides an indication in green, for example. However, arbitrary colors may be specified to indicate the status of a test operation for each refrigerant system, for example.

Further, when the air-conditioning apparatus controller 1 is installed, power is supplied (received) from the indoor unit 60, for example. If the voltage is low, the peak value of the communication waveform is lowered, which tends to result in a communication error. Therefore, according to a related-art technique, the communication waveform is checked by using an oscilloscope or the like, and the voltage is checked by using a tester or the like. According to the air-conditioning apparatus controller 1 of Embodiment 4, the receiving voltage is divided into a plurality of intervals, and a color is assigned to each interval. Thus, it is possible to provide a color indication in accordance with the receiving voltage, and to set these color indication settings.

For example, when the receiving voltage is less than 15 V, the indication is red. Further, when the receiving voltage is 15 V or greater but less than 20 V, the indication is orange.

When the receiving voltage is 20 V or greater but less than 25 V, the indication is yellow. Further, when the receiving voltage is 25 V or greater but less than 30 V, the indication is green. Note that the color of the indication in each interval may be arbitrarily set. In this way, since the light-emitting indicator 20 provides a color indication in accordance with the receiving voltage, in the case where a communication error occurs, for example, it is possible to check the receiving voltage level which might be contributing to the error. This may lead to early detection of the cause.

As described above, a color indication is provided for not only normal operations, but also during installation, and maintenance. This allows the maintenance personnel or the like to more easily perform checks or the like.

In the above-described Embodiments 1 through 4, the wall-mounted controller has been described. However, the present invention is applicable to a wireless remote controller that communicates with an air-conditioning apparatus by radio so as to input instructions and perform displaying and the like.

The invention claimed is:

1. An air-conditioning apparatus controller comprising:

a main body that includes a top, a bottom, and sides that connect the top to the bottom of the main body;

a light-emitting indicator that includes a light emitting diode (LED) that emits light in a plurality of colors and that extends from a position on the bottom of the main body at which the main body shades the light-emitting indicator;

a setting display that displays a plurality of setting screens for light-emitting indication by the light-emitting indicator and that is located on one of the sides of the main body;

a setting interface through which a plurality of instructions related to settings displayed on the setting display is input; and a controller that is housed within the main body, that is electrically connected to the light-emitting indicator, the setting display, and the setting interface, that causes the setting display to display the setting screen, that performs setting processing to interact with a user to arbitrarily select an indication color among a plurality of indication colors and thereafter to assign the selected indication color to mean any indication content to be provided by the light-emitting indicator, in accordance with the instruction transmitted from the setting interface, and that sets an indication usage of the light-emitting indicator, wherein the controller includes an input processing unit electrically connected to the setting interface, a display processing unit electrically connected to both the setting display and the light emitting indicator, a data storage unit that stores settings for the selected indication colors used by the processing performed by the controller, a communication processing unit, and a data processing unit that is electrically connected to the input processing unit, the communication processing unit, and the data storage unit, one of the plurality of instructions includes RGB settings to adjust the selected indication color, the RGB settings displays input buttons to set each of an R-value, a G-value, a B-value, and a blink rate of the light emitting diode for the indication color provided by the light-emitting indicator, the data processing unit of the controller is configured to transmit an RGB setting screen display signal for displaying an RGB setting screen on the setting display to the data storage unit and the display processing unit, the setting display is configured to display the setting screen for light-emitting indication in response to receiving the setting screen display signal, the input processing unit is configured to receive an RGB-input signal that includes user-input values for the R-value, the G-value, the B-value, and the blink rate of the LED for a user-selected indication content, process the RGB-input signal to be readable by the data processing unit, continually output a processed RGB-input signal to the data processing unit as a user changes the user-input values, the data processing unit is configured to receive the processed RGB-input signal, output the processed RGB-input signal to the data storage unit and the display processing unit, and the display processing unit is configured to control the LED of the light-emitting indicator to display the R-value, the G-value, the B-value, and the blink rate included in the processed RGB-input signal on the light-emitting indicator both as the user changes the user-input values and as the user-selected indication content occurs.

2. The air-conditioning apparatus controller of claim 1, wherein the indication usage includes operation mode, operational status, and room temperature.

3. The air-conditioning apparatus controller of claim 1, wherein the controller sets an indication mode of the light-emitting indicator.

4. The air-conditioning apparatus controller of claim 3, wherein the indication mode includes ON, blink, and OFF of the light-emitting indicator.

5. The air-conditioning apparatus controller of claim 1, wherein the setting screen displayed on the setting display includes a plurality of setting screens, and the controller is configured to control the setting display to display a normal indication usage setting screen that displays a selection of an operation mode indication setting, a room temperature indication setting, and an operational status indication setting.

6. The air-conditioning apparatus controller of claim 5, wherein the controller is configured to control the setting display to display an indication usage setting screen that displays a selection of a normal indication usage setting and a maintenance indication usage setting, control the setting display to display the normal indication usage setting screen in response to the normal indication usage setting being selected by a user in the indication usage settings, and control the setting display to display the maintenance indication usage setting screen in response to the maintenance indication usage setting being selected by a user in the indication usage settings, the maintenance indication usage setting screen displays a plurality of maintenance operations that are each assignable to at least one of the indication colors.

7. The air-conditioning apparatus controller of claim 1, wherein the controller is configured to assign one of the plurality of indication colors to each of a plurality of voltage intervals corresponding to a voltage of a communication signal received by the controller, measure the voltage of the communication signal received by the controller during the test operation to determine a strength of the received communication signal, and control the light-emitting indicator to display the indication color corresponding to the voltage of the communication signal that has been measured during the test operation to indicate which of the plurality of voltage intervals has been received by the controller.

8. The air-conditioning apparatus controller of claim 1, wherein the indication content includes a plurality of operational modes, the plurality of operational modes includes a cooling operational mode, a drying operational mode, a fan operational mode, an auto operational mode, a heating operational mode, a turn-on operational mode, a turn-off operational mode, an error operational mode, a test operational mode, and a setback operational mode, the setback operational mode includes a plurality of temperature ranges that are each between a lowest temperature and a highest temperature, and the controller is configured to assign one or more of the plurality of indication colors to different stages of completion of the test operational mode, repeatedly determine the different stages of completion of the test operational mode as a status of completion of the test operational mode, control the light-emitting indicator to display the one or more of the plurality of indication colors or a gradation of the one or more of the plurality of indication colors based on the status of completion of the test operational mode in response to determining the status of completion of the test operational mode, and control the light-emitting indicator to display a different one of the plurality of indication colors or change the gradation of the one or more of the plurality of indication colors in response to determining a change in the status of completion of the test operation mode.

9. The air-conditioning apparatus controller according to claim 1, wherein the input processing unit of the controller is configured to receive a search-and-find identification-display signal to identify the controller responsible for one or more indoor units, the input processing unit is configured to process the search-and-find identification-display signal to be readable by the data processing unit and output a readable identification display signal to the data processing unit, the data processing unit is configured to process the readable identification display signal and output a processed identification display signal to the communication processing unit, and the communication processing unit is configured to send to an external air-conditioning apparatus controller an identification signal that includes one of the plurality of indication colors in accordance with the processed identification display signal to allow a user to identify the controller assigned to the one or more indoor units.

10. An air-conditioning system comprising:

an indoor unit including a first light-emitting indicator that emits light in a plurality of colors; and an air-conditioning apparatus controller including a main body that includes a top, a bottom, and sides that connect the top to the bottom of the main body, a second light-emitting indicator that includes a light emitting diode (LED) and that emits light in a plurality of colors and that extends from a position on the bottom of the main body at which the main body shades the second light-emitting indicator, a setting display that displays a plurality of setting screens for light-emitting indication by the second light-emitting indicator and that is located on one of the sides of the main body, a setting interface through which a plurality of instructions related to settings displayed on the setting display is input, a controller that is housed within the main body, that is electrically connected to the second light-emitting indicator, the setting display, and the setting interface, that causes the setting display to display the setting screen, that performs setting processing to interact with a user to arbitrarily select an indication color among a plurality of indication colors and to assign the selected indication color to mean any indication content to be provided by the first light-emitting indicator and second light-emitting indicator, in accordance with the instruction transmitted from the setting interface, and that sets an indication usage of the first light-emitting indicator and the second light-emitting indicator, and a data storage unit that stores settings for the selected indication colors used by the processing performed by the controller, wherein a command for specifying a color of the light to be emitted by the first light-emitting indicator of the indoor unit or the second light-emitting indicator of the air-conditioning apparatus controller is sent between the indoor unit and the air-conditioning apparatus controller, wherein the controller includes an input processing unit electrically connected to the setting interface, a display processing unit electrically connected to both the setting display and the second light emitting indicator, a data storage unit that stores settings for the selected indication colors used by the processing performed by the controller, a communication processing unit, and a data processing unit that is electrically connected to the input processing unit, the communication processing unit, and the data storage unit, one of the plurality of instructions includes RGB settings to adjust the selected indication color, the RGB settings displays input buttons to set each of an R-value, a G-value, a B-value, and a blink rate of the light emitting diode for the indication color provided by the second light-emitting indicator, the data processing unit of the controller is configured to transmit an RGB setting screen display signal for displaying an RGB setting screen on the setting display to the data storage unit and the display processing unit, the setting display is configured to display the setting screen for light-emitting indication in response to receiving the setting screen display signal, the input processing unit is configured to receive an RGB-input signal that includes user-input values for the R-value, the G-value, the B-value, and the blink rate of the LED for a user-selected indication content, process the RGB-input signal to be readable by the data processing unit, continually output a processed RGB-input signal to the data processing unit as a user changes the user-input values, the data processing unit is configured to receive the processed RGB-input signal, output the processed RGB-input signal to the data storage unit and the display processing unit, and the display processing unit is configured to control the LED of the second light-emitting indicator to display the R-value, the G-value, the B-value, and the blink rate included in the processed RGB-input signal on the second light-emitting indicator both as the user changes the user-input values and as the user-selected indication content occurs.

11. The air-conditioning system of claim 10, wherein the indication usage includes operation mode, operational status, and room temperature.

12. The air-conditioning system of claim 10, wherein the controller sets an indication mode of the first light-emitting indicator and the second light-emitting indicator.

13. The air-conditioning system of claim 12, wherein the indication mode includes ON, blink, and OFF of the first light-emitting indicator and the second light-emitting indicator.

14. The air-conditioning system of claim 10, wherein the controller performs setting for adjusting the plurality of indication colors for the first light-emitting indicator and the second light-emitting indicator.

15. The air-conditioning system of claim 10, wherein the controller sets a blinking rate of the first light-emitting indicator and the second light-emitting indicator.

16. The air-conditioning apparatus controller of claim 10, wherein the indication content includes a plurality of operational modes, the plurality of operational modes includes a cooling operational mode, a drying operational mode, a fan operational mode, an auto operational mode, a heating operational mode, a turn-on operational mode, a turn-off operational mode, an error operational mode, a test operational mode, and a setback operational mode, the setback operational mode includes a plurality of temperature ranges that are each between a lowest temperature and a highest temperature, and the controller of the air-conditioning apparatus controller is configured to assign one or more of the plurality of indication colors to different stages of completion of the test operational mode for the indoor unit, repeatedly determine the different stages of completion of the test operational mode for the indoor unit as a status of completion of the test operational mode for the indoor unit, control the second light-emitting indicator of the air-conditioning apparatus controller to display the one or more of the plurality of indication colors or a gradation of the one or more of the plurality of indication colors based on the status of completion of the test operational mode for the indoor unit in response to determining the status of completion of the test operational mode for the indoor unit, and control the second light-emitting indicator of the air-conditioning apparatus controller to display a different one of the plurality of indication colors or change the gradation of the one or more of the plurality of indication colors in response to determining a change in the status of completion of the test operation mode for the indoor unit.

17. The air-conditioning system of claim 10, wherein the input processing unit of the controller is configured to receive a search-and-find identification-display signal to identify the controller responsible for one or more indoor units, the input processing unit is configured to process the search-and-find identification-display signal to be readable by the data processing unit and output a readable identification display signal to the data processing unit, the data processing unit is configured to process the readable identification display signal and output a processed identification display signal to the communication processing unit, and the communication processing unit is configured to send to an external air-conditioning apparatus controller an identification signal that includes one of the plurality of indication colors in accordance with the processed identification display signal to allow a user to identify the controller assigned to the one or more indoor units.

18. An air-conditioning system comprising:

a plurality of indoor units each including a first light-emitting indicator that emits light in a plurality of colors; and a plurality of the air-conditioning apparatus controllers each including a main body that includes a top, a bottom, and sides that connect the top to the bottom of the main body, a second light-emitting indicator that includes a light emitting diode (LED) and that emits light in a plurality of colors and that extends from a position on the bottom of the main body in which the main body shades the second light-emitting indicator, a setting display that displays a plurality of setting screens for light-emitting indication by the first light-emitting indicator and the second light-emitting indicator and that is located on one of the sides of the main body, a setting interface through which a plurality of instructions related to settings displayed on the setting display is input, a controller that is housed within the main body, that is electrically connected to the second light-emitting indicator, the setting display, and the setting interface, that causes the setting display to display the setting screen, that performs setting processing to interact with a user to arbitrarily select an indication color among a plurality of indication colors and thereafter to assign the selected indication color to mean any indication content to be provided by the first light-emitting indicator and the second light-emitting indicator, in accordance with the instruction transmitted from the setting interface, and that sets an indication usage of the first light-emitting indicator and the second light-emitting indicator, and a data storage unit that stores settings for the selected indication colors used by the processing performed by the controller, wherein the controller includes an input processing unit electrically connected to the setting interface, a display processing unit electrically connected to both the setting display and the second light emitting indicator, a data storage unit that stores settings for the selected indication colors used by the processing performed by the controller, a communication processing unit, and a data processing unit that is electrically connected to the input processing unit, the communication processing unit, and the data storage unit, the indoor units are divided into groups, each of the air-conditioning apparatus controllers is provided for a corresponding group, a color of the light to be emitted by the first light-emitting indicator and the second light-emitting indicator for identification of a group is assigned to each of the indoor units in the group and the air-conditioning apparatus controller for the group, one of the plurality of instructions includes RGB settings to adjust the selected indication color, the RGB settings displays input buttons to set each of an R-value, a G-value, a B-value, and a blink rate of the light emitting diode for the indication color provided by the second light-emitting indicator, the data processing unit of the controller is configured to transmit an RGB setting screen display signal for displaying an RGB setting screen on the setting display to the data storage unit and the display processing unit, the setting display is configured to display the setting screen for second light-emitting indication in response to receiving the setting screen display signal, the input processing unit is configured to receive an RGB-input signal that includes user-input values for the R-value, the G-value, the B-value, and the blink rate of the LED for a user-selected indication content, process the RGB-input signal to be readable by the data processing unit, continually output a processed RGB-input signal to the data processing unit as a user changes the user-input values, the data processing unit is configured to receive the processed RGB-input signal, output the processed RGB-input signal to the data storage unit and the display processing unit, and the display processing unit is configured to control the LED of the second light-emitting indicator to display the R-value, the G-value, the B-value, and the blink rate included in the processed RGB-input signal on the second light-emitting indicator both as the user changes the user-input values and as the user-selected indication content occurs.

19. The air-conditioning system of claim 18, wherein the indication usage includes operation mode, operational status, and room temperature.

20. The air-conditioning system of claim 18, wherein the controller sets an indication mode of the first light-emitting indicator and the second light-emitting indicator.

21. The air-conditioning system of claim 20, wherein the indication mode includes ON, blink, and OFF of the first light-emitting indicator and the second light-emitting indicator.

22. The air-conditioning system of claim 18, wherein the controller performs setting for adjusting the plurality of indication colors for the first light-emitting indicator and the second light-emitting indicator.

23. The air-conditioning system according to claim 18, wherein the indication content includes a plurality of operational modes, the plurality of operational modes includes a cooling operational mode, a drying operational mode, a fan operational mode, an auto operational mode, a heating operational mode, a turn-on operational mode, a turn-off operational mode, an error operational mode, a test operational mode, and a setback operational mode, the setback operational mode includes a plurality of temperature ranges that are each between a lowest temperature and a highest temperature, and the controller of each of the air-conditioning apparatus controllers is configured to assign one or more of the plurality of indication colors to different stages of completion of the test operational mode for the indoor units of the corresponding group of indoor units, repeatedly determine the different stages of completion of the test operational mode for one or more of the indoor units of the corresponding group of indoor units as a status of completion of the test operational mode for one or more of the indoor units of the corresponding group of indoor units, control the second light-emitting indicator of the air-conditioning apparatus controller to display the one or more of the plurality of indication colors or a gradation of the one or more of the plurality of indication colors based on the status of completion of the test operational mode for one or more of the indoor units of the corresponding group of indoor units in response to determining the status of completion of the test operational mode for one or more of the indoor units of the corresponding group of indoor units, and control the second light-emitting indicator of the air-conditioning apparatus controller to display a different one of the plurality of indication colors or change the gradation of the one or more of the plurality of indication colors in response to determining a change in the status of completion of the test operation mode for one or more of the indoor units of the corresponding group of indoor units.

24. The air-conditioning system according to claim 18, wherein the input processing unit of the controller is configured to receive a search-and-find identification-display signal to identify the one of the plurality of air-conditioning apparatus controllers responsible provided for one of the groups of indoor units, the input processing unit is configured to process the search-and-find identification-display signal to be readable by the data processing unit and output a readable identification display signal to the data processing unit, the data processing unit is configured to process the readable identification display signal and output a processed identification display signal to the communication processing unit, and the communication processing unit is configured to send to the one of the plurality of air-conditioning apparatus controllers an identification signal that includes one of the plurality of indication colors in accordance with the processed identification display signal to allow a user to identify the one of the plurality of air-conditioning apparatus controllers responsible provided for one of the groups of indoor units.

* * * * *